US007195453B2

(12) United States Patent
Martin et al.

(10) Patent No.: US 7,195,453 B2
(45) Date of Patent: Mar. 27, 2007

(54) COMPRESSOR STATOR FLOATING TIP SHROUD AND RELATED METHOD

(75) Inventors: Nicholas Francis Martin, Simpsonville, SC (US); John David Memmer, Simpsonville, SC (US); Ronald Stuart Denmark, Greenville, SC (US)

(73) Assignee: General Electric Company, Schenectady, NY (US)

( * ) Notice: Subject to any disclaimer, the term of this patent is extended or adjusted under 35 U.S.C. 154(b) by 150 days.

(21) Appl. No.: 10/928,735

(22) Filed: Aug. 30, 2004

(65) Prior Publication Data

US 2006/0045747 A1 Mar. 2, 2006

(51) Int. Cl.
*F01D 9/00* (2006.01)

(52) U.S. Cl. ..... 415/138; 415/209.3

(58) Field of Classification Search ..... 415/137, 415/138, 209.2, 209.3, 209.4, 210.1
See application file for complete search history.

(56) References Cited

U.S. PATENT DOCUMENTS

| | | | | |
|---|---|---|---|---|
| 2,625,013 | A * | 1/1953 | Howard et al. | 60/800 |
| 2,801,076 | A * | 7/1957 | Terrell et al. | 415/137 |
| 3,142,475 | A * | 7/1964 | Bobo et al. | 415/139 |
| 4,169,692 | A | 10/1979 | McDonough et al. | |
| 4,193,738 | A | 3/1980 | Landis, Jr. et al. | |
| 6,296,442 | B1 * | 10/2001 | Tran | 415/209.4 |
| 6,409,472 | B1 * | 6/2002 | McMahon et al. | 415/189 |

* cited by examiner

*Primary Examiner*—Edward K. Look
*Assistant Examiner*—Nathan Wiehe
(74) *Attorney, Agent, or Firm*—Nixon & Vanderhye P.C.

(57) ABSTRACT

A stator blade segment for a compressor includes an inner ring segment and an outer ring segment and a plurality of stator blades extending radially between the inner and outer ring segments, the stator blade secured to the outer ring at a shank portion of the blade and loosely held in a slot in the inner ring segment at a tip portion of the blade, the slot formed to substantially match a cross-sectional profile of the tip portion of the blade but sized to create a clearance between the tip portion and the slot.

10 Claims, 3 Drawing Sheets

COMPRESSOR STATOR FLOATING TIP SHROUD AND RELATED METHOD

BACKGROUND OF THE INVENTION

This invention relates to industrial gas turbine technology and specifically, to a floating tip shroud configuration for a compressor stator.

Severe loading of cantilevered stator blades, caused by off-design operation, may result in incident angles and pressure gradients that cause damaging, unsteady aerodynamic forces. These aerodynamic forces have led, under certain conditions, to stator blade failure. In particular, the flow around a stator blade tip, from pressure to suction side, has been shown to create forces of sufficient magnitude and frequency to lead to failure of the blade.

This problem is amplified, for example, in the last stator stages of certain heavy-duty industrial turbines, due to tip clearance effects when the cantilevered stator is positioned between two static ring segments which undergo significant temperature variations. The outer ring (or outer carrier ring) is typically fixed to the compressor outer case while the inner ring (or tip shroud) is typically secured to the compressor inner barrel. During turbine startup, the gas path and stator blade temperatures increase rapidly, closely followed by the inner ring. The outer ring has a much slower thermal response due to its size and thermal boundaries. The cantilevered stator blades are attached via the outer ring, to the outer compressor case and therefore follow the outer case radial growth. Since it is undesirable to have any flexible, cantilevered blades contact the inner ring, a large clearance between the blade tips and the inner ring is required. The startup transient defines the required clearance to prevent contact. During steady state operation, the outer ring has warmed up and pulls the stator blades away from the inner ring, thereby increasing the tip clearance. Increased tip clearance has been shown to increase the unsteady aerodynamic loading.

One prior solution has been to weld tip shrouds on the blade tips. While this does eliminate the tip clearance issue, it creates a number of new cost and manufacturing challenges. There is a continuing need, therefore, for a much simpler and less expensive solution to the above problems.

BRIEF DESCRIPTION OF THE INVENTION

In accordance with an exemplary embodiment, a uniquely configured floating tip shroud forms the inner flow path of the stator blade tips and eliminates compressor stator separated flow vibration induced by tip leakage vortex bursting. As is normally the case, the tip shroud is divided into a plurality of circumferential segments, each accommodating several blades. The floating tip shroud segments are arranged to be flush with the compressor inner barrel to match the axial flow path profile. In addition, slots are provided in each of the floating tip shroud segments that conform to the profiles of the blade tip sections, allowing the blades to move radially within the slots or openings. Each floating tip shroud segment (or simply, tip shroud) has a radial thickness sufficient to allow the full range of thermal growth differences between the stator blade, the inner ring, and the external case (including the outer ring) without disengagement of the blade tips from the slots and without bottoming of the blade tips on the compressor inner barrel.

It will be appreciated that the floating tip shroud is circumferentially segmented to match the similarly segmented stator blade packs. Each stator blade pack incorporates a number of blades secured to the outer carrier ring by dovetail joints, strapping or other suitable means. In any event, the outer carrier ring must be circumferentially constrained. The preferable constraint location is at the circumferential center of the outer ring although other locations may be utilized. Specifically, a pin may be passed through a hole in the outer carrier ring and threaded into the compressor case wall. This constraint reacts to the sector blade gas loads and provides for improved spacing between segments, thus eliminating the large gaps created at the split line locations with the current constraint scheme. Access to this central bolt location is achieved through holes in the compressor case wall.

The floating tip shroud is also circumferentially and radially constrained. Just as with the outer ring constraint, the preferable constraint location is at the circumferential center of the shroud segment. In this way, the floating tip shroud can be rigidly secured, by a threaded bolt for example, to the inner barrel of the compressor while allowing free thermal expansion in circumferential directions. Access to the floating tip shroud bolt may be provided by the center bolt hole location on the outer ring.

The floating tip radial constraints are provided at the circumferential ends in order to reduce transient thermal arching. If required, access can be provided by holes in the outer carrier ring and compressor case, located radially outward from the floating tip shroud bolt location. Thus, the inner ring or tip shroud is free to thermally move with the inner barrel, as well as circumferentially through the use of racetrack-shaped bolt holes for the radial constraint bolts.

The floating tip shroud segments may also incorporate circumferential overlap features with adjacent sectors. This minimizes flow path disruptions and tip shroud leakage.

Accordingly, in its broadest aspects, the present invention relates to a stator blade segment for a compressor comprising an inner ring segment and an outer ring segment and a plurality of stator blades extending radially between the inner and outer ring segments, each stator blade secured to the outer ring at a shank portion of the blade and loosely held in a slot in the inner ring segment at a tip portion of the blade, the slot formed to substantially match a cross-sectional profile of the tip portion of the blade but sized to create a clearance between the tip portion and the slot.

In another aspect, the invention relates to a stator blade segment for a compressor comprising an inner ring segment and an outer ring segment and a plurality of stator blades extending radially between the inner and outer ring segments, each stator blade secured to the outer ring at a shank portion of the blade and loosely held in a slot in the inner ring segment at a tip portion of the blade, the slot formed to substantially match a cross-sectional profile of the tip portion of the blade but sized to create a clearance between the tip portion and the slot; wherein the inner ring segment has a depth sufficient to retain the tip portion between radially inner and outer surfaces of the inner ring segment under all operating conditions of the compressor; and wherein the inner ring segment is provided with a circumferentially centered hole and a pair of circumferentially spaced racetrack-shaped holes proximate opposite ends of the inner ring segment.

In still another aspect, the invention relates to a method of capturing cantilevered tips of compressor stator blades comprising (a) providing an inner ring component formed with a plurality of slots, each slot matching a cross-sectional profile of a tip portion of a respective stator blade; (b) loading the tip portion of each stator blade into a respective one of the slots; and (c) securing shank portions of the stator blades in an outer ring segment.

The invention will now be described in connection with the drawing figures identified below.

DETAILED DESCRIPTION OF THE INVENTION

Figure 1:
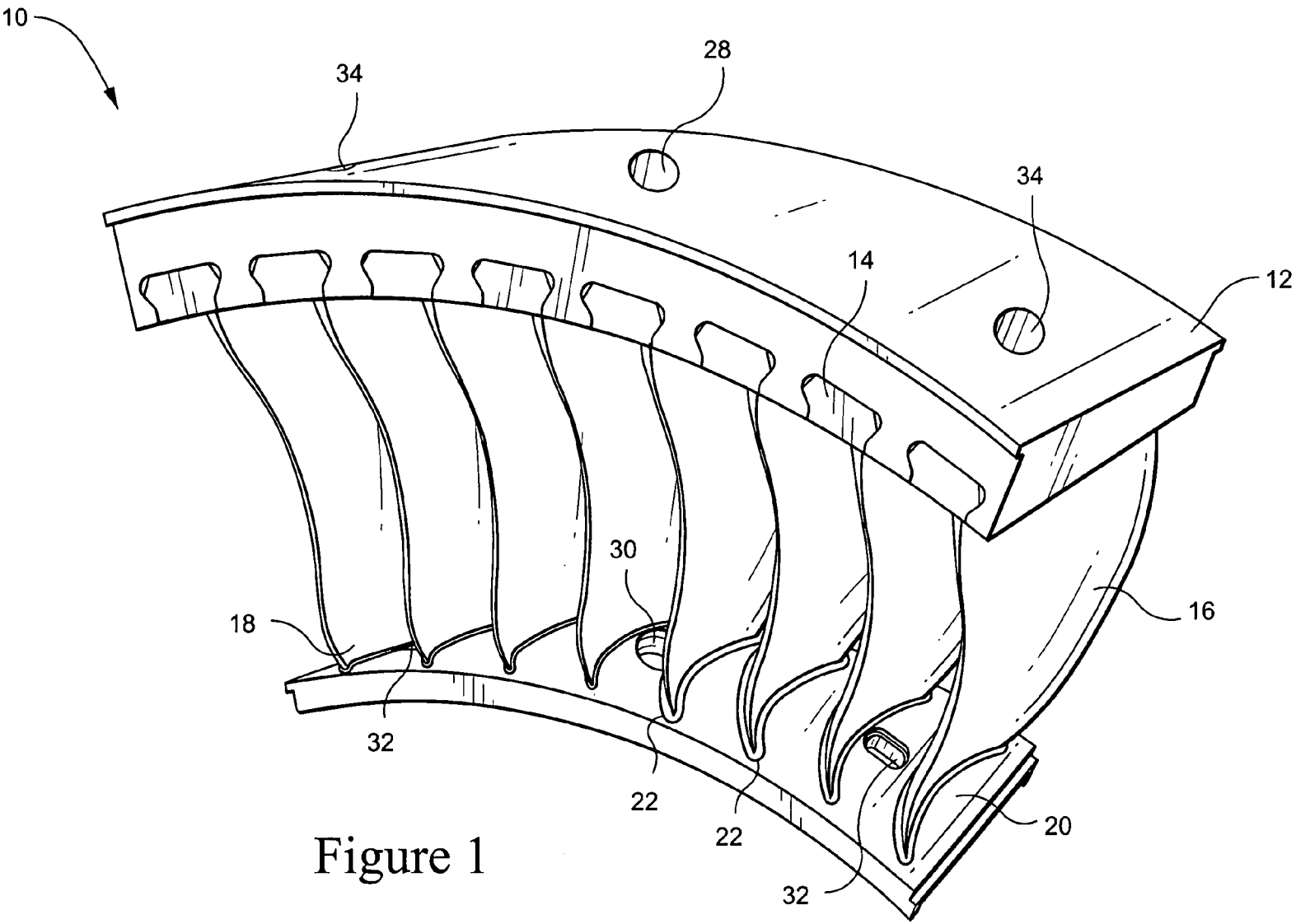
FIG. 1 is a perspective view of a floating tip shroud segment in accordance with an exemplary embodiment of the invention.

With reference to FIG. 1, a compressor stator segment 10 includes an outer carrier ring or base segment 12 formed with a plurality of axially oriented dovetail slots 14 by which a plurality of stator blades 16 are secured to the outer ring in conventional fashion. It will be appreciated, however, that other means may be employed for securing the blades to the outer ring. The cantilevered stator blades 16 have radially inner tips 18 that are loosely secured within a floating tip shroud segment 20, the circumferential extent of which is designed to accommodate a like number of stator blades 16. In accordance with the exemplary embodiment of the invention, the inner tips 18 of the stator blades 16 are loosely held within airfoil slots 22 that are cut through the tip shroud segment 20, and that closely match the blade tip cross section. It will be understood that positive clearance between the blade tip portions 18 and the tip shroud cutouts or slots 22 must be maintained for all operating conditions. Thus, the slots 22, while matching the profile of the blade tips, are nevertheless oversized to provide the necessary clearance.

Figure 2:
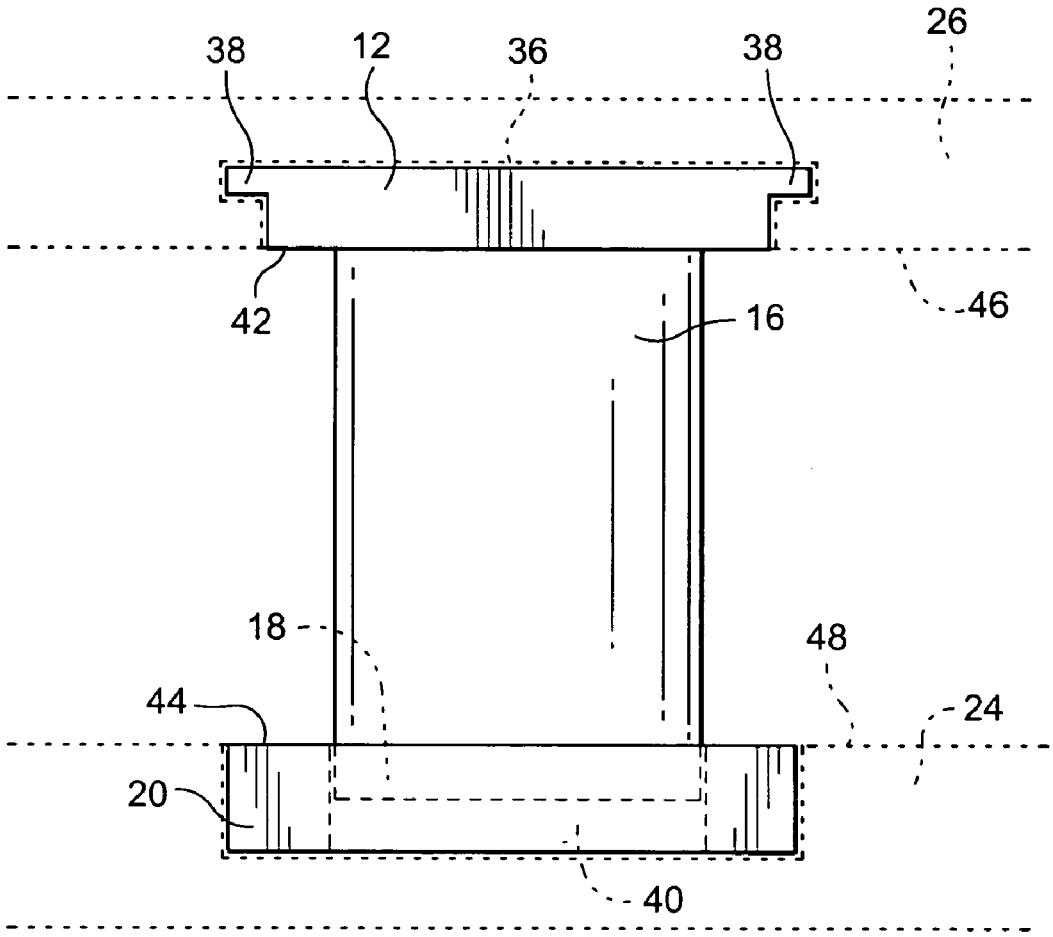
FIG. 2 is a simplified tangential view of the tip shroud shown in FIG. 1.

With reference to FIG. 2, the radial thickness or depth of the tip shroud 20 is sufficient to allow for radial thermal growth and contraction of the stator blades 16. Specifically, the thickness or depth of the inner ring or tip shroud 20 is selected to ensure that the stator blade tips will not engage the compressor inner barrel 24, nor will the blade tips pull out of the slots 22 due to thermal expansion or contraction (see FIG. 2).

The stator outer carrier ring 12 must be circumferentially constrained to avoid excess circumferential movement by the various segments. Preferably, a constraint pin (not shown) is threaded into the compressor outer case 26 and a smooth shank portion of the pin extends into a hole 28 (FIG. 1) in the outer carrier ring. This circumferential constraint reacts to the sector blade gas loads and provides for improved spacing between adjacent segments, eliminating the large gaps created at the split line locations with current segment configurations. At the same time, radial thermal growth of the outer ring is permitted. Access to the hole 28 is achieved through holes in the compressor case wall.

The floating tip shroud 20 must also be both circumferentially and radially constrained. To this end, a central bolt hole 30 is located centrally of the tip shroud segment 20, with a bolt extending radially from the segment 20 and into the compressor inner barrel 24 so as to fix the segment to the barrel, so that the tip shroud segment is fixed for radial growth with the inner barrel. Access to hole 30 is provided by means of the bolt hole 28 on the outer carrier ring 12.

Radial constraints are provided at the circumferential ends of each tip shroud segment by means of racetrack-shaped or circumferentially elongated slot bolt holes 32, with bolts extending from the tip shroud segment into the inner barrel. The racetrack-shaped holes 32 permit circumferential growth of the tip shroud segment in two opposite directions in order to reduce transient thermal arching. Access to holes 32 may be provided by holes 34 in the stator outer carrier ring 12, and in the compressor outer case.

As best seen in FIG. 2, the outer ring segment is received within T-shaped grooves 36 formed in the compressor outer case 26, with shoulders 38 on opposite sides of the tip shroud segment serving to constrain radial movement of the outer segment. The inner ring or tip shroud 20 is secured within cutout 40 on the inner barrel 24 and thus expands radially with the inner barrel.

With reference again to FIG. 2, note that inner and outer ring surfaces 42, 44, respectively, are maintained flush with the adjacent respective surfaces 46, 48 of the compressor case wall 26 and inner barrel 24. In this way, there is no interference with the flow path as otherwise defined by surfaces 46, 48 even with differential thermal expansion of the blade 16.

Figure 3:
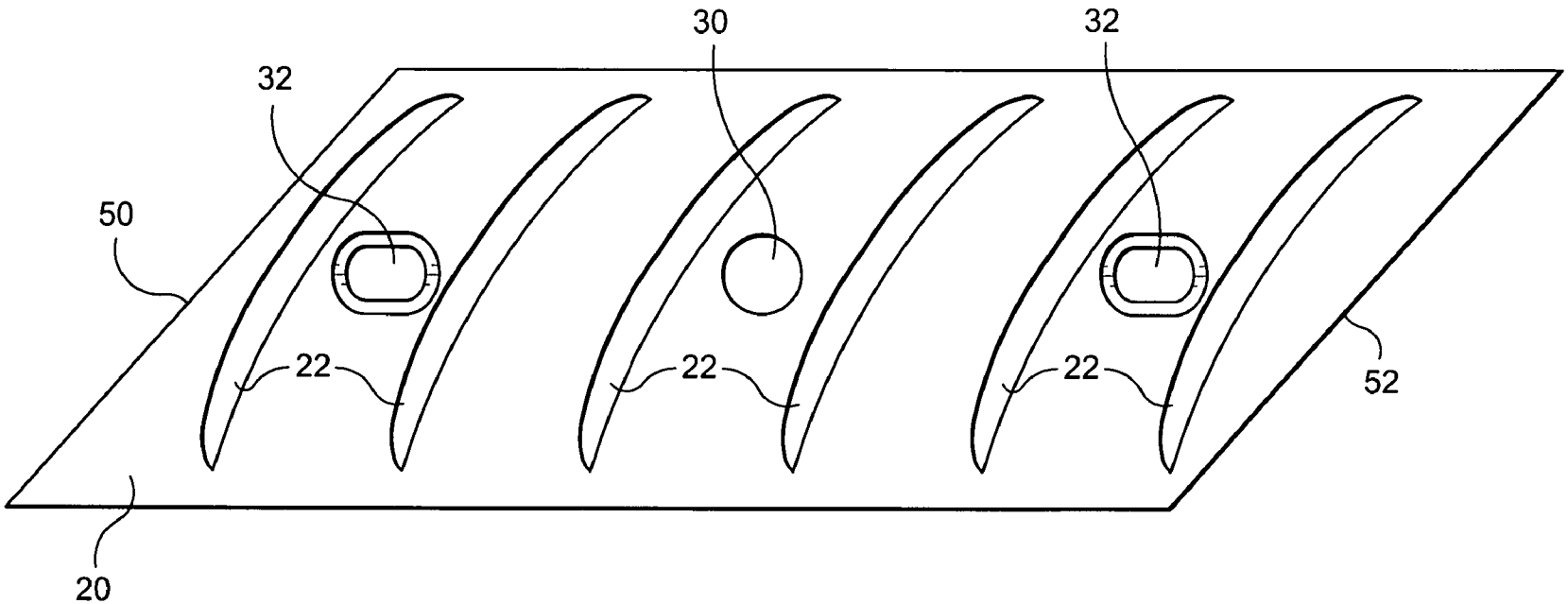
FIG. 3 is a radial plan view of the floating tip shroud projected onto a flat plane.

It is also apparent from FIG. 3 that the angled segment end surfaces 50, 52 provide circumferential overlap features with adjacent segments to minimize flow path disruptions and tip shroud leakage.

The installation of the stator segment will now be described. In constructing each stator segment, the tips of the appropriate number of stator blades 16 slide into corresponding slots 22 in the floating tip shroud segment 20, with self-locking fixture bolts already in place in the tip shroud segment. Thereafter, the outer carrier ring 12 or stator base strap is applied. The floating tip shroud 20 will remain on the blade tips 18 without fixturing if there are sufficient blades in the segment to provide "wheel spoke" support, or if the radial slots 22 have a sufficiently small clearance to the blade tip cross section. If neither of these latter conditions are met, then some holding mechanism or fixture would be required.

The outer ring segment 12 is then slid into the case loading slot 36 on both the top and bottom halves of the case. The bottom half segments may be attached to the inner barrel by aligning the outer ring segment constraint holes with the case access holes and then reaching through the case, the stator base segment and across the flow path to tighten the floating tip shroud self-locking bolt. If additional bolts are required on the floating tip shroud, then access and tightening would be through additional case and stator base holes. Thereafter, the outer ring circumferential constraint bolts are applied through the case hole access. Any other access holes are filled with pins or plugs, flush with the outside diameter flow path, but sufficiently loose to prevent thermal binding.

The compressor case top half is then installed following the same procedure. The top half segments require temporary installation of the stator base constraint bolt in order to hold the segments in the slots until the top case is installed. Disassembly would be achieved by following the opposite procedure.

With the above-described tip shroud configuration, flow around the cantilevered blade tip is eliminated; a smooth inside diameter flow path is provided under all operating conditions; current blade surface finish and profile tolerances are maintained; and no sealing scheme is required around the blade tips and compressor inner barrel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator blade segment for a compressor comprising an inner ring segment and an outer ring segment and a plurality of stator blades extending radially between said inner and outer ring segments, each stator blade secured to said outer ring at a shank portion of said blade and centrally located within a slot in said inner ring segment at a tip portion of said blade, said slot formed to substantially match a cross-sectional profile of said tip portion of said blade but sized to create a positive clearance between said tip portion and said slot for all operating conditions of the compressor, and wherein said inner ring segment is provided with a circumferentially centered radially oriented hole for securing the inner ring segment to a radially inner barrel, and a pair of spaced circumferentially elongated, radially oriented holes proximate opposite ends of said inner segment ring for producing radial constraint while permitting circumferential thermal growth.

2. The stator blade segment of claim 1 wherein said inner ring segment has a depth sufficient to encompass said tip portion between radially inner and outer surfaces of said inner ring segment for said all operating conditions of the compressor, thereby aerodynamically isolating said stator blade tip.

3. The stator blade segment of claim 1 wherein end surfaces of said radially outer segment are slanted relative to a direction of flow across the blades.

4. A stator blade segment for a compressor comprising an inner ring segment and an outer ring segment and a plurality of stator blades extending radially between said inner and outer ring segments, each stator blade secured to said outer ring at a shank portion of said blade and loosely held in a slot in said inner ring segment at a tip portion of said blade, said slot formed to substantially match a cross-sectional profile of said tip portion of said blade but sized to create a clearance between said tip portion and said slot wherein said inner ring segment is provided with a circumferentially centered radially oriented hole for securing the inner ring segment to a radially inner barrel, and a pair of spaced circumferentially elongated holes proximate opposite ends of said inner segment ring for permitting circumferential thermal growth, wherein said outer ring segment has at least one hole therein radially aligned with said circumferentially centered hole in said inner ring segment.

5. A stator blade segment for a compressor comprising an inner ring segment and an outer ring segment and a plurality of stator blades extending radially between said inner and outer ring segments, each stator blade secured to said outer ring at a shank portion of said blade and loosely held in a slot in said inner ring segment at a tip portion of said blade, said slot formed to substantially match a cross-sectional profile of said tip portion of said blade but sized to create a clearance between said tip portion and said slot wherein said inner ring segment is provided with a circumferentially centered radially oriented hole for securing the inner ring segment to a radially inner barrel, and a pair of spaced circumferentially elongated holes proximate opposite ends of said inner segment ring for permitting circumferential thermal growth, wherein said outer ring segment is provided with holes radially aligned with said circumferentially centered hole in said inner ring segment and said pair of circumferentially elongated holes.

6. The stator blade segment of claim 5 wherein end surfaces of said radially outer segment are slanted relative to a direction of flow across the blades.

7. A stator blade segment for a compressor comprising an inner ring segment and an outer ring segment and a plurality of stator blades extending radially between said inner and outer ring segments, each stator blade secured to said outer ring at a shank portion of said blade and centrally located within a slot in said inner ring segment at a tip portion of said blade, said slot formed to substantially match a cross-sectional profile of said tip portion of said blade but sized to create a positive clearance between said tip portion and said slot for all operating conditions of the compressor; wherein said inner ring segment has a depth sufficient to retain said tip portion between radially inner and outer surfaces of said inner ring segment under said all operating conditions of the compressor; and wherein said inner ring segment is provided with a circumferentially centered, radially oriented hole and at least one circumferentially elongated, radially oriented racetrack-shaped hole proximate at least one end of said inner ring segment to thereby radially constrain said segment while permitting circumferential thermal growth.

8. A method of capturing cantilevered tips of compressor stator blades in a compressor comprising:

(a) providing an inner ring component formed with a plurality of slots, each slot matching a cross-sectional profile of a tip portion of a respective stator blade but sized to create a positive clearance between said tip portion and aid slot for all operating conditions of the compressor;

(b) loading the tip portion of each stator blade into a respective one of said slots such that said tip portion is centrally located within said slot;

(c) rigidly securing each inner ring component to a radially inner barrel by means of a bolt circumferentially centered along said inner segment extending through a radially oriented hole, and by means of bolts extending through a pair of circumferentially-elongated, radially oriented holes adjacent opposite ends of the segment such that said inner ring segment is radially constrained while permitting circumferential thermal growth; and (d) securing shank portions of said stator blades in an outer ring segment.

9. The method of claim 8 and further comprising making the inner ring with a depth sufficient to retain said tip portion between radially inner and outer surfaces of said inner ring segment under all operating conditions of the compressor.

10. The method of claim 8 and further comprising mounting said outer ring segment to an outer case wall of the compressor and constraining the outer ring segment against circumferential growth while permitting radial growth.

* * * * *